US010765282B2

(12) United States Patent
Lubbers

(10) Patent No.: US 10,765,282 B2
(45) Date of Patent: Sep. 8, 2020

(54) VACUUM CLEANER

(71) Applicant: KONINKLIJKE PHILIPS N.V., Eindhoven (NL)

(72) Inventor: Matthijs Hendrikus Lubbers, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 16/301,331

(22) PCT Filed: Nov. 22, 2017

(86) PCT No.: PCT/EP2017/079982
§ 371 (c)(1),
(2) Date: Nov. 13, 2018

(87) PCT Pub. No.: WO2018/099771
PCT Pub. Date: Jun. 7, 2018

(65) Prior Publication Data

US 2019/0335966 A1 Nov. 7, 2019

(30) Foreign Application Priority Data

Dec. 3, 2016 (EP) ..... 16202085

(51) Int. Cl.
*A47L 9/16* (2006.01)
*A47L 5/28* (2006.01)
*A47L 9/24* (2006.01)

(52) U.S. Cl.
CPC ..... *A47L 9/1666* (2013.01); *A47L 5/28* (2013.01); *A47L 9/165* (2013.01); *A47L 9/248* (2013.01)

(58) Field of Classification Search
CPC ..... A47L 5/28; A47L 9/1666; A47L 9/165; A47L 9/242; A47L 9/248
(Continued)

(56) References Cited

U.S. PATENT DOCUMENTS 5,337,443 A 8/1994 Steinberg
5,898,971 A 5/1999 Contant
(Continued)

FOREIGN PATENT DOCUMENTS

CN 202386621 U 8/2012
CN 103082937 A 5/2013
(Continued)

*Primary Examiner* — David Redding

(57) ABSTRACT

A vacuum cleaner comprises a nozzle (N) for cleaning a surface, a suction tube (T) for receiving input air from the nozzle (N), a cyclone device having a cyclone (C) and a dirt container (DC) both oriented substantially perpendicular to the suction tube (T), a cyclone device input coupled to the suction tube (T) from which the input air is transported, following a spiral around a center, in a first direction substantially perpendicular to the suction tube (T) to reach a stage (V) at which dirt is separated from the input air to obtain cyclone output air, from which stage the cyclone output air is conveyed through a conduit in a second direction substantially perpendicular to the suction tube (T) and opposite to the first direction to arrive at a cyclone device output, a filter (F) for filtering the cyclone output air, and an airflow generator (A) for generating an airflow through the suction tube (T), the cyclone (C) and the filter (F), wherein when the nozzle (N) is touching the surface, the suction tube (T) is put in a substantially horizontal position, the first and second directions are substantially perpendicular to the surface, with the notion substantially perpendicular allowing for a deviation of not more than 35 degrees.

19 Claims, 2 Drawing Sheets

(58) Field of Classification Search
USPC ..... 15/344, 353
See application file for complete search history.

(56) References Cited

U.S. PATENT DOCUMENTS

| | | | |
|---|---|---|---|
| 5,950,274 | A | 9/1999 | Kilstroem |
| 7,276,099 | B2 | 10/2007 | Hayashi |
| 2001/0023517 | A1 | 9/2001 | Onishi |
| 2016/0015228 | A1 | 1/2016 | Conrad et al. |
| 2016/0270615 | A1 | 9/2016 | Kawamura |

FOREIGN PATENT DOCUMENTS

| | | | |
|---|---|---|---|
| CN | 103705171 | | 4/2014 |
| EP | 1136029 | A2 | 9/2001 |
| EP | 1356755 | A2 | 10/2003 |
| GB | 284146 | A | 4/2012 |
| JP | 2000083879 | A | 3/2000 |
| JP | 2002085297 | A | 3/2002 |
| JP | 2003061883 | A | 3/2003 |
| JP | 2003070706 | A | 3/2003 |
| JP | 2003204903 | A | 7/2003 |
| JP | 2003210370 | A | 7/2003 |
| JP | 2005270312 | A | 10/2005 |
| JP | 2006087961 | A | 4/2006 |
| JP | 2015160071 | A | 9/2015 |
| WO | 2014131105 | A1 | 9/2014 |

VACUUM CLEANER

This application is the U.S. National Phase application under 35 U.S.C. § 371 of International Application No. PCT/EP2017/079982, filed on Nov. 22, 2017, which claims the benefit of International Application No. 16202085.3 filed on Dec. 3, 2016. These applications are hereby incorporated by reference herein.

FIELD OF THE INVENTION

The invention relates to a vacuum cleaner, and in particular to a handheld vacuum cleaner.

BACKGROUND OF THE INVENTION

US 2016/0015228 describes a hand-carryable surface cleaning apparatus, which comprises a main body housing a suction motor, and a cyclone bin assembly. The suction motor is oriented at an angle to a vertical axis and a horizontal axis.

EP 1136029 discloses an electric vacuum cleaner. A dust suction air flow is introduced through an inlet into a cyclone-type dust collector portion, which turns the dust suction air flow into a whirling air flow so as to separate dust with the resulting centrifugal force. Thereafter, the dust suction air flow is exhausted out of the main body through an outlet.

SUMMARY OF THE INVENTION

It is, inter alia, an object of the invention to provide an improved vacuum cleaner. The invention is defined by the independent claims. Advantageous embodiments are defined in the dependent claims.

In accordance with a preferred embodiment of the invention, a vacuum cleaner comprises a nozzle for cleaning a surface, a suction tube for receiving input air from the nozzle, a cyclone device having a cyclone and a dirt container both oriented substantially perpendicular to the suction tube, a cyclone device input coupled to the suction tube from which the input air is transported (swirled, i.e. following a spiral around a center) in a first direction substantially perpendicular to the suction tube to reach a stage at which dirt is separated from the input air to obtain cyclone output air, from which stage the cyclone output air is conveyed through a conduit in a second direction substantially perpendicular to the suction tube and opposite to the first direction to arrive at a cyclone device output, a filter for filtering the cyclone output air, and an airflow generator for generating an airflow through the suction tube, the cyclone and the filter, wherein when the nozzle is touching the surface and the suction tube is put in a substantially horizontal position, the first and second directions are substantially perpendicular to the surface, with the notion substantially perpendicular allowing for a deviation of not more than 35 degrees.

Herein, the suction tube is defined as the straight channel between the nozzle and any bends just before an input of the cyclone device. As the cyclone and the dirt container are oriented substantially perpendicular to the suction tube, dirt cannot fall out of the dirt container when the suction tube is substantially horizontal. Herein, the notion substantially perpendicular allows for an embodiment in which the cyclone is tilted by between 15 and 35 degrees, which allows for a compact construction in which the airflow generator is arranged very close to the cyclone device and the filter. A compact arrangement with a favorable weight distribution is obtained in an embodiment in which the airflow generator is arranged below a handle.

Advantageously, when the suction tube is in a substantially horizontal position, the cyclone device, the filter and the airflow generator substantially do not extend below the suction tube. Preferably, an air channel has no bends for a length of at least 25 mm before the cyclone device input.

These and other aspects of the invention will be apparent from and elucidated with reference to the embodiments described hereinafter.

DESCRIPTION OF EMBODIMENTS

In the embodiments shown in the figures, a single cyclone C to separate the dirt from the air for use in vacuum cleaners has the following setup. Air enters a cylinder and follows a spiral around a cone in the center. Due to G forces, dirt is transported to the outside of the cylindrical wall. At the opening at the outside of the wall, dirt is transported to a dirt container DC. The air leaves the cyclone C via the cone V in the center. The air is then filtered by the filter F to take out some fine dust; for this purpose, various conventional filters can be used. The clean air goes via the airflow generator A outside the appliance. Various conventional vacuum cleaner motor fan aggregates can be used as airflow generator A for generating an airflow through the suction tube T, the cyclone C and the filter F.

Design restriction for the dirt management system, comprising bucket, cyclone and filter, are that it is compact and close to handle H, and that it needs to be connected via an air channel to the airflow generator A. To reduce pressure loss, this air channel should be short and wide with a minimum of bends. This also holds for the air inlet channel.

To make a more compact dirt management system, to have a center of mass close to the handle H, and to minimize the bend in front of the cyclone C, the cyclone C and dirt compartment DC are placed next to each other and perpendicular to the suction tube T. The requirements for making a high performing vacuum cleaner with perfect reach are: suction tube can be put flat to the floor, compact design (center of mass close to the handle), no steep bends at cyclone inlet, and no steep bend at cyclone outlet. The cyclone C and the airflow generator A are positioned close to the handle H, as this is the most optimal place for the center of mass, and as having the thick components as far away as possible from the nozzle N at the other end of the suction tube T maximizes the possibility to clean below chairs and couches, such as a sofa S. The connection between the suction tube T and the nozzle N should allow for the suction tube T to lay substantially flat on the floor.

Figure 1:
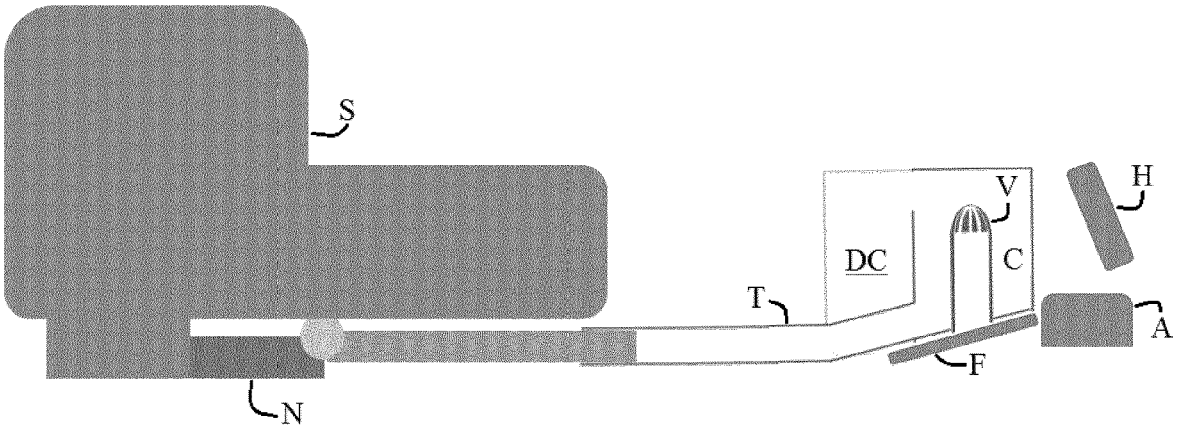
FIG. 1 shows a schematic diagram of a first embodiment of a vacuum cleaner in accordance with the present invention when used to clean below a sofa.
Figure 2:
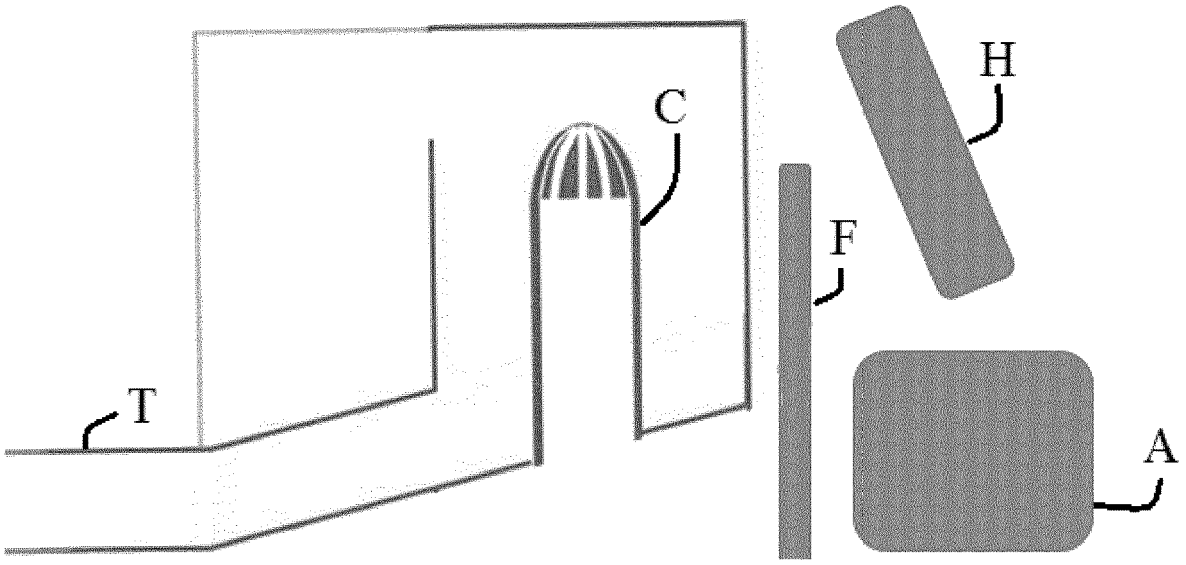
FIGS. 2-4 shows schematic diagrams of a second through fourth embodiments of a vacuum cleaner in accordance with the present invention.
Figure 3:
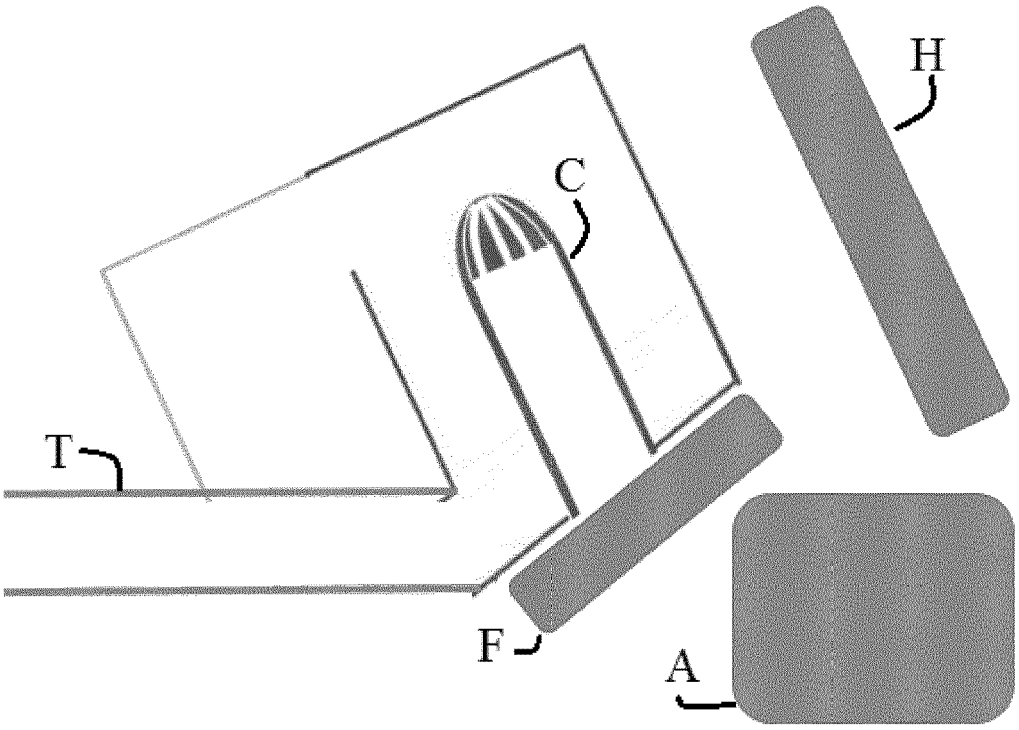
Figure 4:
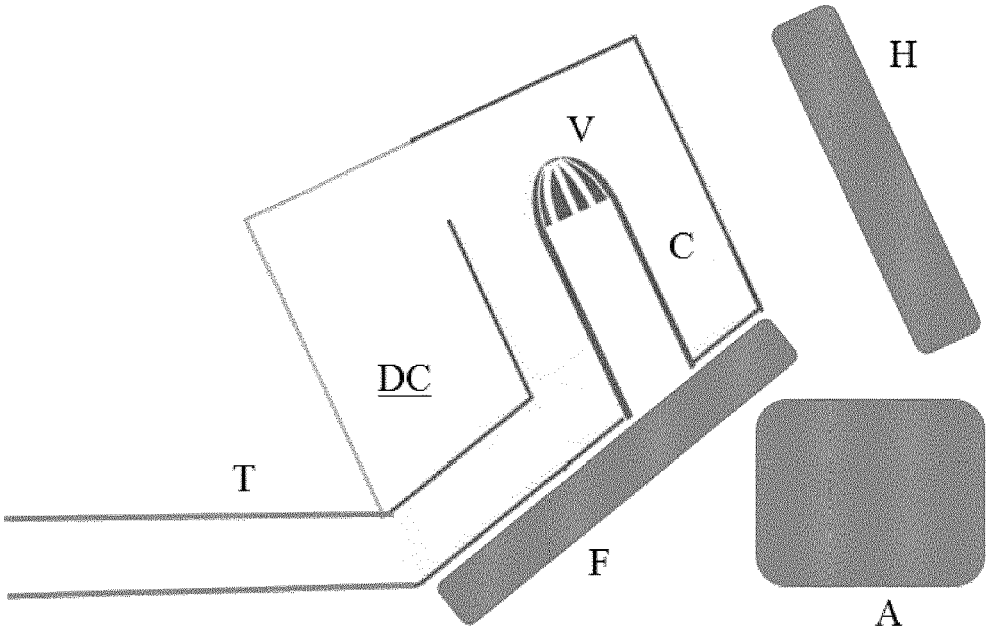

In accordance with a preferred embodiment, an optimal setup of components to accommodate the best reach with a compact high performing appliance is the following. A suction tube T is the lowest component on the appliance when situated horizontal. A cyclone C is substantially perpendicular to the suction tube T to minimize a bend towards the inlet of the cyclone and to make it more compact. The tube T enters the cyclone device at its bottom side, and the air from which dirt has been separated leaves via the bottom side of the cyclone C. An airflow generator A is placed behind the cyclone. The figures show two options for placing a filter F, viz. below the cyclone C, as shown in FIGS. 1, 3 and 4, or behind the cyclone C as shown in FIG. 2.

As some airflow generators are capable of handling the air from the cyclone C, which air still contains some dirt, it is alternatively possible to place the filter F downstream of the airflow generator A when such airflow generators are used.

One embodiment of the invention thus provides a high performing, multi-usage vacuum cleaner which accommodates the current demands of the user regarding ergonomics, reach and performance, where all components are placed above or in line with the tube. The dirt management system, comprising bucket, cyclone and filter, is designed in such a manner that it is compact, high performing and the suction tube T can be put in a substantially horizontal position close to the floor. By doing so, it is made easier for a user to clean below furniture such as a sofa S.

A battery operated vacuum cleaner contains three components which are dominant contributors to the overall weight of the appliance. The airflow generator A, the dirt management system (cyclone, bucket, filter), and the power source. As described above, the center of mass should be close to the handle H. To have the optimal position for the center of mass, the three components which are dominant contributors to the weight should be arranged close to the handle in a compact manner. The most dominant contributor in size is the dirt management system.

In further embodiments, as shown in FIGS. 3 and 4, the cyclone C is parallel to the handle H, where the handle H is tilted forward by about 25 degrees compared to a line perpendicular to the suction tube T. This results in very good ergonomics. Tilting the cyclone C forward allows to place the airflow generator A adjacent to the dirt management system with a wide channel without steep curves, so almost no pressure drop. The airflow generator A is positioned adjacent the lower end of the handle H. This setup gives the most compact appliance and results in the center of mass being close to the handle H.

Tilting the cyclone by more than about 25 degrees will hamper the filling of the dirt container DC when the dirt container DC is placed in front of the cyclone C as shown in the drawings. The dirt will spray out of the cyclone exit against the wall of the bucket opposite to the exit. When tilted by more than 25 degrees, the dirt will not slide down the wall during normal operation (in which the tube is at about a 45 degrees angle to the floor). This means the exit can be blocked while the dirt container DC has a lot of empty space.

A negative effect that needs to be overcome is an additional pressure drop due to a bend in front/entrance at the cyclone. A main contributor to the pressure drop is due to the turbulence which is created by the bend. When the bend is close to the cyclone, as shown in FIG. 3, turbulent air enters the cyclone which generates the increase in pressure drop. Tests show that when for at least 25 mm before the cyclone entrance, there is a straight flow channel, as shown in FIG. 4, the additional pressure drop is negligible and can be compared to a fully straight entrance. This counts only in the situation when the cyclone C not tilted by more than 25+/−10 degrees forward.

Another advantage of having the bend 25 mm before the cyclone entrance is that there is more place for the filter F when placed below the cyclone output. A bigger filter area reduces also the pressure drop and has a bigger dirt-holding capacity. The bigger filter has in this situation no negative impact on compactness. Another advantage is that by doing so, also the airflow generator A does not substantially extend below the suction tube T, thereby facilitating a horizontal position of the suction tube T allowing the vacuum cleaner to more easily clean below furniture.

An optimal setup of components to accommodate the best ergonomics with a compact high performing appliance is the following. A handle H tilted forward by about 25 degrees with a single cyclone C parallel (+/−5 degree) to the handle H. The airflow generator A is adjacent to the handle H and directly adjacent to the exit of the dirt management system. A power source (battery, not shown) may be located between the airflow generator A and the handle H. The air channel in front of the entrance of the cyclone is straight for at least 25 mm.

It should be noted that the above-mentioned embodiments illustrate rather than limit the invention, and that those skilled in the art will be able to design many alternative embodiments without departing from the scope of the appended claims. The claims should not be interpreted as requiring that the filter F is placed upstream of the airflow generator A; as mentioned above, the filter F may alternatively be placed downstream of the airflow generator A. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A vacuum cleaner comprising:

a nozzle (N) for cleaning a surface;

a suction tube (T) for receiving input air from the nozzle (N);

a cyclone device having a cyclone (C) and a dirt container (DC) both oriented substantially perpendicular to the suction tube (T), a cyclone device input coupled to the suction tube (T) from which the input air is transported, following a spiral around a center, in a first direction substantially perpendicular to the suction tube (T) to reach a stage (V) at which dirt is separated from the input air to obtain cyclone output air, from which stage the cyclone output air is conveyed through a conduit in a second direction substantially perpendicular to the suction tube (T) and opposite to the first direction to arrive at a cyclone device output, wherein the cyclone (C) and a handle (H) are titled towards the suction tube (T) by an angle of between 15 and 35 degrees compared to a line perpendicular to the suction tube (T);

a filter (F) for filtering the cyclone output air; and an airflow generator (A) for generating an airflow through the suction tube (T), the cyclone (C) and the filter (F), wherein when the nozzle (N) is touching the surface and the suction tube (T) is put in a substantially horizontal position, the first and second directions are substantially perpendicular to the surface.

2. A vacuum cleaner as claimed in claim 1, wherein when the suction tube (T) is in a substantially horizontal position, the cyclone device, the filter (F) and the airflow generator (A) substantially do not extend below the suction tube (T).

3. A vacuum cleaner as claimed in claim 1, wherein the airflow generator (A) is arranged below a handle (H).

4. A vacuum cleaner as claimed in claim 1, in which an air channel has no bends for a length of at least 25 mm before the cyclone device input.

5. A vacuum cleaner, comprising:

a nozzle (N) disposed at a distal end of the vacuum cleaner;

a suction tube (T) being coupled to the nozzle (N) and adapted to receive input air from the nozzle (N);

a cyclone device (CD) comprising a cyclone (C) and a dirt container (DC), an input to the cyclone device being coupled to the suction tube (T) from which the input air is transported in a first direction substantially perpendicular to the suction tube (T) to reach a stage (V), wherein dirt is separated at stage (V) from the input air to obtain cyclone output air, cyclone output air being conveyed through a conduit in a second direction substantially perpendicular to the suction tube (T) and opposite to the first direction to arrive at a cyclone device output, wherein the cyclone (C) and a handle (H) are tilted towards the suction tube (T) by an angle of between 15 and 35 degrees compared to a line perpendicular to the suction tube (T);

a filter (F) adapted to filter the cyclone output air; and an airflow generator (A) adapted to cause an airflow through the suction tube (T), the cyclone (C), and the filter (F), wherein when the nozzle (N) is touching a surface and the suction tube (T) is disposed in a substantially horizontal position, the first and second directions being substantially perpendicular to the surface, wherein the cyclone device (CD) and the airflow generator (A) are disposed at a proximal end of the vacuum cleaner.

6. The vacuum cleaner as claimed in claim 5, wherein when the suction tube (T) is in a substantially horizontal position, the cyclone device (CD), the filter (F) and the airflow generator (A) do not extend substantially below the suction tube (T).

7. The vacuum cleaner as claimed in claim 6, wherein the airflow generator (A) is arranged below a handle (H).

8. The vacuum cleaner as claimed in claim 5, wherein the cyclone (C) and a handle (H) are tilted towards the suction tube (T) by an angle of approximately 25 degrees compared to a line perpendicular to the suction tube (T).

9. The vacuum cleaner as claimed in claim 6, in which an air channel has no bends for a length of at least 25 mm before the input to the cyclone device.

10. The vacuum cleaner as claimed in claim 6, wherein the suction tube (T) enters the cyclone device at its bottom side, and the air from which dirt has been separated leaves via the bottom side of the cyclone (C).

11. The vacuum cleaner as claimed in claim 10, wherein the airflow generator (A) is placed behind the cyclone (C).

12. The vacuum cleaner as claimed in claim 11, wherein the filter (F) is disposed below the cyclone (C).

13. The vacuum cleaner as claimed in claim 11, wherein the filter (F) is disposed behind the cyclone (C).

14. A vacuum cleaner, comprising:

a nozzle (N);

a suction tube (T) coupled to the nozzle (N) and adapted to receive input air from the nozzle (N);

a cyclone device (CD) comprising a cyclone (C) and a dirt container (DC), an input to the cyclone device being coupled to the suction tube (T) from which the input air is transported in a first direction substantially perpendicular to the suction tube (T) to reach a stage (V), wherein dirt is separated at stage (V) from the input air to obtain cyclone output air, the cyclone output air being conveyed through a conduit in a second direction substantially perpendicular to the suction tube (T) and opposite to the first direction to arrive at a cyclone device output, wherein the cyclone (C) and a handle (H) are tilted towards the suction tube (T) by an angle of between 15 and 35 degrees compared to a line perpendicular to the suction tube (T);

a filter (F) adapted to filter the cyclone output air;

an airflow generator (A) adapted to cause an airflow through the suction tube (T), the cyclone (C), and the filter (F), wherein when the nozzle (N) is touching a surface and the suction tube (T) is disposed in a substantially horizontal position, the first and second directions are substantially perpendicular to the surface; and a handle (H) disposed above the airflow generator (A), wherein the cyclone (C) and the dirt container (DC) are disposed next to each other and perpendicular to the suction tube to provide a center of mass of the vacuum cleaner close to the handle (H).

15. The vacuum cleaner as claimed in claim 14, wherein when the suction tube (T) is in a substantially horizontal position, the cyclone device, the filter (F) and the airflow generator (A) do not extend substantially below the suction tube (T).

16. The vacuum cleaner as claimed in claim 14, wherein the suction tube (T) enters the cyclone device at its bottom side, and the air from which dirt has been separated leaves via the bottom side of the cyclone (C).

17. The vacuum cleaner as claimed in claim 16, wherein the airflow generator (A) is placed behind the cyclone (C).

18. The vacuum cleaner as claimed in claim 17, wherein the filter (F) is disposed below the cyclone (C).

19. The vacuum cleaner as claimed in claim 17, wherein the filter (F) is disposed behind the cyclone (C).

* * * * *